US005086817A

United States Patent [19]

Murphy

[11] Patent Number: 5,086,817

[45] Date of Patent: Feb. 11, 1992

[54] FOAM-SUPPRESSING APPARATUS FOR FILLING BEER PITCHER

[76] Inventor: David J. Murphy, 200 Bayshore Blvd., #107, Clearwater, Fla. 34619

[21] Appl. No.: 591,150

[22] Filed: Oct. 1, 1990

[51] Int. Cl.[5] ..... B67C 3/22

[52] U.S. Cl. ..... 141/271; 141/266; 141/86; 141/277; 141/369; 141/377

[58] Field of Search ..... 141/86, 88, 128, 250, 141/266, 271, 272, 275, 277, 278, 369, 373, 377

[56] References Cited

U.S. PATENT DOCUMENTS

| | | | |
|---|---|---|---|
| 382,023 | 5/1888 | Bauer | 141/271 |
| 436,999 | 9/1890 | Rempen | 141/278 |
| 532,235 | 1/1895 | Grap | 141/377 |
| 939,978 | 11/1909 | Champ | 141/271 X |
| 3,094,154 | 6/1963 | Daniels | 141/88 |
| 4,456,040 | 6/1984 | Bacroix et al. | 141/377 X |
| 4,944,332 | 7/1990 | Belland | 141/88 |

FOREIGN PATENT DOCUMENTS

| | | | |
|---|---|---|---|
| 559173 | 9/1923 | France | 141/272 |
| 2827 | of 1886 | United Kingdom | 141/272 |

*Primary Examiner*—Ernest G. Cusick
*Attorney, Agent, or Firm*—Stanley M. Miller

[57] ABSTRACT

A device that holds a pitcher at a preselected angle of tilt while the pitcher is being filled with a beverage. Where beer is the beverage, the angle of tilt ensures that the beer will flow down the inner side walls of the pitcher, thereby suppressing the foam or head that would develop if the pitcher were charged while in an upright disposition. The weight of the beer as it gradually fills the pitcher gradually overcomes the bias that causes the initial tilting so that the head is continually suppressed throughout the charging operation and so that the pitcher is completely upright when filled. The device saves its user from having to hold a heavy pitcher at a tilted position throughout the charging process.

19 Claims, 2 Drawing Sheets

FOAM-SUPPRESSING APPARATUS FOR FILLING BEER PITCHER

BACKGROUND OF THE INVENTION

1. Technical Field

This invention relates, generally, to devices having utility in filling beer pitchers. More particularly, it relates to a self-righting apparatus that initially holds a pitcher in a tilted position.

2. Background Art

Beer foams or forms a head when poured directly into a glass or pitcher, as is well known. It is equally well known that the head can be suppressed by beginning the charging operation with the container tilted so that the initial stream of brew impinges the container near its rim so that it must run down the side of the container before hitting the bottom thereof.

A pitcher of beer is heavy, particularly when it is nearly full. A busy bartender is soon weary of holding pitchers of beer in the proper tilted position until the pitcher fills up, but customers will complain if he or she fails to do since customers are not pleased when asked to pay for copious quantities of foam.

There is a need, therefore, for an inexpensive apparatus that would allow the bartender to relax while a pitcher of beer was being filled, but the prior art, taken as a whole, neither teaches nor suggests how such an apparatus could be provided.

SUMMARY OF THE INVENTION

The longstanding but heretofore unfulfilled need for a device that holds a beer pitcher in the proper tilted position during the charging operation is now fulfilled by an elegant device that has a biased beer-pitcher platform means that holds an empty pitcher of beer in a predetermined initial angular position relative to the vertical and that positions the rim of the empty pitcher directly under a beer-dispensing nozzle when the pitcher is empty. The weight of the beer as the pitcher fills gradually overcomes the bias so that the pitcher is gradually righted as it fills. Thus, the beer from the nozzle is directed onto the side of the pitcher as the pitcher fills and the pitcher is upright and ready for grasping by the bartender by the time the pitcher is full.

A primary object of this invention is to pioneer the art of self-righting beer pitcher holders.

Another, more specific, object is to provide the needed holder in the form of a device of virtually irreducible simplicity so that the low manufacturing costs thereof will translate into an easily affordable device at the retail level of distribution.

These and other objects and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENT

Figure 1:
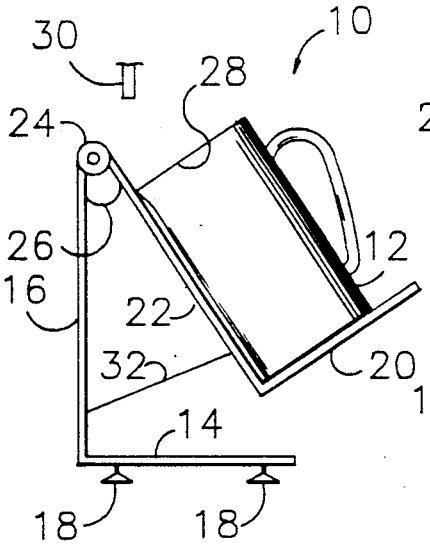
FIG. 1 is a side elevational view, in diagrammatic form, of the novel device when holding an empty beer pitcher.
Figure 2:
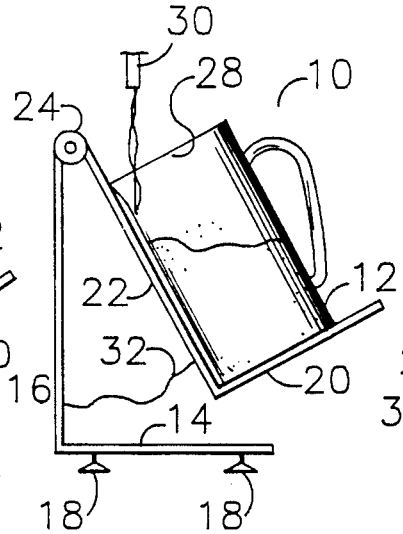
FIG. 2 is a similar view, but showing the orientation of the device when the pitcher is about half filled with beer or other liquid.
Figure 3:
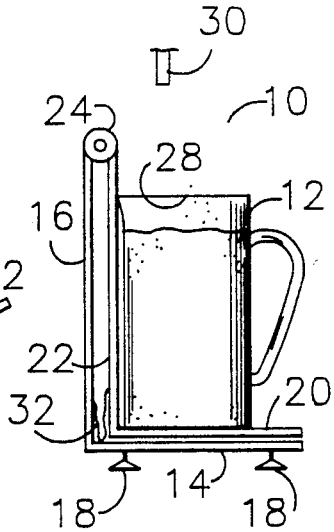
FIG. 3 is a similar view, but showing the device in its pitcher-full, self-righted position.

Referring now to FIGS. 1–3, which show the novel apparatus in diagramatic form only for explanatory purposes, it will there be seen that an illustrative embodiment of the invention is denoted by the reference numeral 10 as a whole.

Device 10 is shown supporting a beer or soft drink pitcher 12 in FIGS. 1–3. The pitcher 12 is empty in FIG. 1, about half full in FIG. 2 and substantially full in FIG. 3.

Device 10 includes a substantially horizontal base 14 which may be solid or of open mesh or other suitable construction, and an upright first back wall 16 which also may be of solid construction, open mesh construction, or other suitable construction. First back wall 16 is fixedly secured to base 14 at a rearward edge thereof, in orthogonal relation thereto. As will become clear as this description proceeds, back wall 16 could be provided in the form of a pair of laterally spaced apart, upstanding post members, for example.

Base 14 and first back wall 16 collectively form the base means of this invention and form an "L" shape in side elevation.

Base 14 may be supported by suitably positioned non-skid support members such as suction cups 18.

Pitcher 12 is supported from below by a pitcher platform 20 and a support means or second back wall 22 orthogonal thereto upon which is mounted a contoured rubber pad, not shown in FIGS. 1–3, which cushions the cylindrical sidewalls of pitcher 12 when it is cradled by device 10.

Platform 20 and second back wall 22 collectively form the platform means of this invention and also form an "L" shape in side elevation.

Adjustable bias means 24 surmounts and hingedly interconnects first and second back walls 16 and 22. Bias means 24 thus forms and is coincident with a pivot axis about which the second back wall pivots forwardly with respect to the stationary first back wall 16. Importantly, the amount of bias is preselected so that walls 16 and 22 are disposed at a preselected acute angle 26 when no pitcher is positioned on the device and when an empty pitcher is disposed thereupon as depicted in FIG. 1.

Accordingly, the base means and the platform means of this invention are pivotally connected to one another at their respective uppermost ends and are biased away from one another. Due to the stationary aspect of the base means, bias means 24 continually urges the platform means to pivot away from the base means in a forwardly direction about the pivot axis defined by the bias means.

Just as importantly, the bias is carefully preselected so that about half of the forward bias is overcome when pitcher 12 is about half full of beer or other preselected beverage as depicted in FIG. 2 and so that the pitcher is vertically disposed when full as depicted in FIG. 3. Clearly, the bias of the internally biased hinge 24 is completely overcome by the weight of a full pitcher. The angle 26 between first and second back walls 16 and 22 becomes substantially zero when the pitcher is full, i.e., the first and second back walls are disposed in substantially parallel relation to one another when the pitcher is full. It should therefore be noted that there is a plurality of angular positions of functional adjustment between initial acute angle 26 and the final position of the device when supporting a beverage-filled pitcher.

To use the novel device, the bartender initially positions it so that the uppermost rim 28 of an empty pitcher is positioned directly below a nozzle 30 of the type that dispenses beer or other drinks, such as soft drinks, which are also commonly charged into large pitchers. Suction cups 18 are then firmly pressed down so that no further realignment of device 10 will ever be needed, and the nozzle 30 is activated in the usual way. As clearly understandable from FIG. 1, the initial stream of beer or soft drink will impinge the pitcher 12 just below uppermost rim 28, thereby constraining the liquid to flow down the cylindrical inner sidewalls of the pitcher in route to the bottom thereof. If beer is the liquid being charged into pitcher 12, the head thereof will be suppressed just as if the bar tender had carefully held the pitcher in a tilted position at the commencement of the charging operation.

Angle 26 gradually decreases as the pitcher fills and becomes heavier, and the pitcher is fully righted as the nozzle shuts off.

A limiting means 32 is employed to limit the maximum angular disposition between first and second back walls 16 and 22 as is clearly shown in FIG. 1. Limiting means 32 could be provided in the form of a string, rope, cable, chain or other suitable flexible connecting device. Means 32 is taut as depicted in FIG. 1 when the load on bias means 24 is at its minimum value. Means 32 loses its tautness as the bias 24 is overcome as is shown in FIGS. 2 and 3.

Those of ordinary skill in the mechanical arts generally and in the art of machine design in particular could make and use a device incorporating the teachings and suggestions of the above disclosure without further instruction from the inventor thereof, but a further, more detailed description of an exemplary embodiment of the invention follows, and reference should now be made to FIGS. 4–7.

Figure 4:
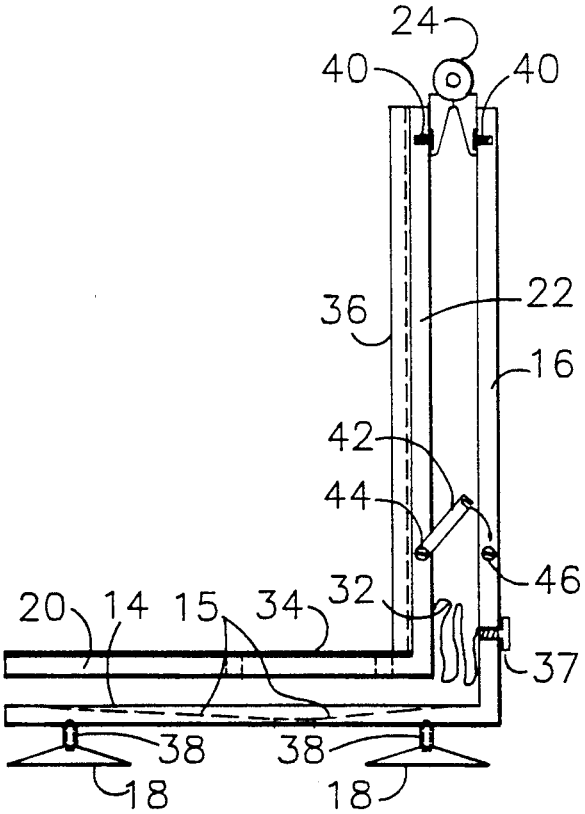
FIG. 4 is a side elevational view of an illustrative embodiment of the invention.

As shown in FIG. 4, a thin non-skid pad 34 of rubber or other suitable high friction material is disposed in overlying relation to pitcher-supporting platform 20. A thick, contoured rubber pad 36 overlies second back wall 22 of the pitcher-supporting means. The pitcher-mating contour of pad 36 and its pitcher-cushioning and cradling function is perhaps best depicted and explained in FIG. 6.

FIG. 4 further shows peg 37 having utility in adjusting the length of string 32, screws 38 for mounting suction cups 18 to base 14, screws 40 for mounting bias means 24 to walls 16 and 22, and a latch member 42 for holding first and second back walls 16 and 22 in parallel relation to one another as depicted in FIG. 4 when no pitcher is positioned upon platform 20. Latch member 42 is pivotal about its axis 44 and a free end thereof releasably engages screw 46, as is clear from FIG. 4, to lock the empty device into the storage position shown in FIG. 4. It is worthy of note that the flexible limiting means 32 mentioned earlier could also be provided in the form of a pivotally mounted, rigid latch means such as latch 42.

Figure 5:
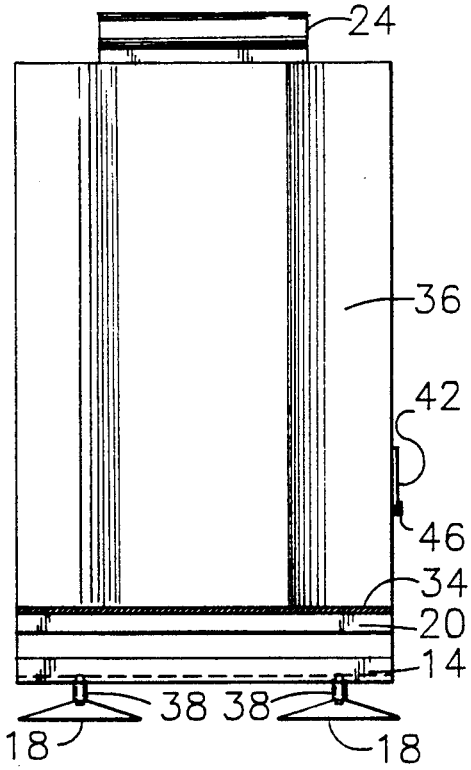
FIG. 5 is a front elevational view thereof.
Figure 6:
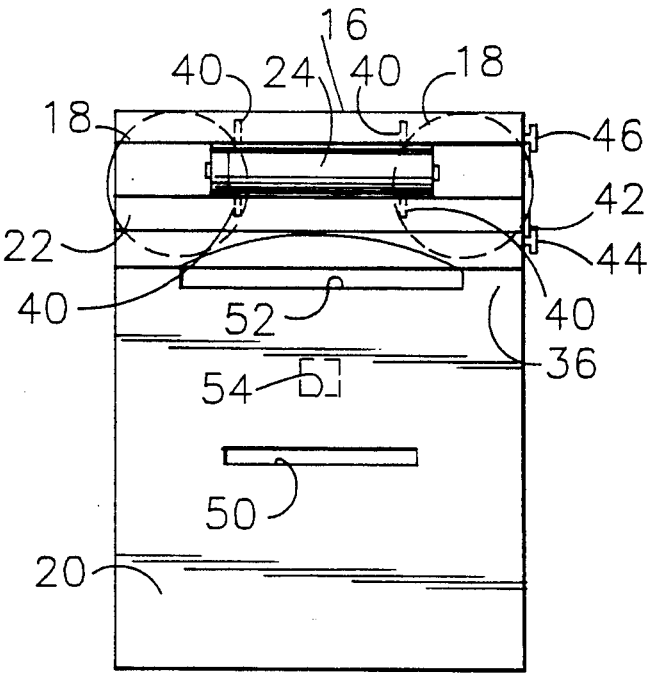
FIG. 6 is a top plan view thereof.

A frontal view of the novel device is provided in FIG. 5, and a top plan view is provided in FIG. 6. Drainage slots 50, 52 are formed in platform 20 to allow spilled liquids to drain from said platform onto base 14 therebelow. Another drainage hole 54 is formed in base 14 to permit drainage of the liquids therefrom.

As best shown in FIG. 4, the top surface of base 14 is sloped as at 15 to direct liquids into said drainage hole 54. Base 14 could also be of open mesh construction to provide a drainage capability.

Figure 7:
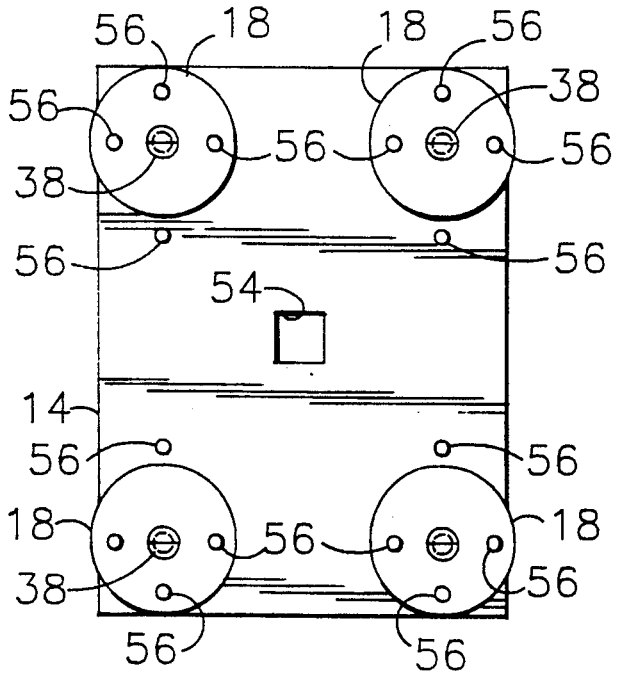
FIG. 7 is a bottom plan view thereof.

The bottom view of FIG. 7 shows apertures, collectively denoted 56, formed in base 14. These apertures may serve as alternative mounting means for suctions cups 18.

Numerous variations of structure can be made to the novel device shown and described herein without departing from the scope of the claims that follow. Moreover, the materials employed in fabricating the device include any suitable material.

Clearly, this invention is new and useful. Just as importantly, it was not obvious to those of ordinary skill in the pertinent art at the time it was made, in view of the prior art, taken as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device having utility in connection with the charging of a beverage into a pitcher, comprising:

a base, a first back wall fixedly secured to a rearward end of said base in orthogonal relation thereto, said base and said first back wall collectively forming a base means, a platform for supporting a pitcher, a second back wall fixedly secured to a rearward end of said platform in orthogonal relation thereto, said platform and said second back wall collectively forming a platform means, said base means and said platform means being pivotally secured to one another along a pivot axis, a bias means disposed in interconnecting relation to said base means and said platform means, said bias means being operative to urge said platform means to pivot away from said base means.

2. The device of claim 1, wherein the amount of bias of said bias means is preselected to position said second back wall at a first preselected acute angle with respect to said first back wall when said platform means is supporting an empty pitcher and at a plurality of preselected angles less than said acute angle when said platform means is supporting a pitcher that is at least partially filled, one of said plurality of angles being substantially zero degrees so that said first and second back walls are substantially parallel to one another when said platform means is supporting a pitcher that is substantially filled with a preselected beverage.

3. The device of claim 1, further comprising an angle limiting means for limiting the maximum angular disposition between said first and second back walls.

4. The device of claim 1, further comprising a latch for holding said first and second back walls in substantially parallel relation to one another when the device is in a storage configuration.

5. The device of claim 1, further comprising a contoured pitcher-cushioning means disposed in overlying relation to said second back wall.

6. The device of claim 1, further comprising a non-slip pad disposed in overlying relation to said platform.

7. The device of claim 1, further comprising a plurality of non-skid members being secured to an underside of said base.

8. The device of claim 7, wherein said plurality of non-skid members are suction cups.

9. The device of claim 1, further comprising at least one drainage means being formed in said platform.

10. The device of claim 9, further comprising at least one drainage means being formed in said base.

11. A device having utility in connection with the charging of a beverage into a pitcher, comprising:

an "L"-shaped base having an elongate part and a truncate part, an "L"-shaped platform having an elongate part and a truncate part, said platform being positioned upwardly and forwardly of said base, in closely spaced relation thereto, a hinge for hingedly interconnecting said base and said platform to one another, said hinge being positioned adjacent a common upper end of said base and said platform, said hinge defining a pivotal axis about which said platform pivots with respect to said base, said hinge being internally biased to urge said platform to pivot away from said base, said internal bias being insufficient to pivot said platform away from said base when said platform is supporting a pitcher that is substantially filled with a liquid.

12. The device of claim 11, further comprising means for limiting the maximum angular disposition between said platform and said base.

13. The device of claim 12, further comprising means for latching together said base and said platform when said platform is not supporting a pitcher filled with a beverage.

14. The device of claim 13, further comprising a cushioned pad member disposed in overlying relation to said elongate part of said platform, said cushioned pad member having a surface that conforms to the outer surface of a pitcher supported by said platform.

15. The device of claim 14, further comprising a non-skid pad member disposed in overlying relation to said truncate part of said platform.

16. The device of claim 15, further comprising non-skid means disposed on a bottom side of said truncate part of said base to hold said device in position on a support surface.

17. The device of claim 16, wherein said non-skid means is provided in the form of plural suction cup members.

18. The device of claim 16, further comprising a drainage means being formed in said platform.

19. The device of claim 18, further comprising a drainage means being formed in said base.

* * * * *